United States Patent [19]

Seymour et al.

[11] 4,200,171

[45] Apr. 29, 1980

[54] END CAP AND SUSPENSION MEANS FOR ACOUSTICAL CEILING BAFFLE

[75] Inventors: Merritt W. Seymour, Sylvania; Barry R. Wyerman, Reynoldsburg; Gary R. Steffy, Columbus, all of Ohio

[73] Assignee: Owens-Corning Fiberglas Corporation, Toledo, Ohio

[21] Appl. No.: 973,310

[22] Filed: Dec. 26, 1978

[51] Int. Cl.[2] ..... E04B 5/52

[52] U.S. Cl. ..... 181/287; 181/291; 181/295; 52/144; 16/87 R

[58] Field of Search ..... 181/30, 284, 286, 287, 181/290, 291, 295; 160/84 R, 84 V, 84 H, 135, 231 A; 49/409–411; 16/87 R, 87.2; 52/144, 145

[56] References Cited

U.S. PATENT DOCUMENTS

| | | | |
|---|---|---|---|
| 2,502,020 | 3/1950 | Olson | 181/295 |
| 2,704,865 | 3/1955 | Siering | 181/295 |
| 2,882,990 | 4/1959 | Mustoe | 181/295 |
| 2,915,115 | 12/1959 | Reynolds | 181/287 |
| 2,994,112 | 8/1961 | Stephens | 181/295 |
| 3,159,235 | 12/1964 | Young et al. | 181/286 |
| 3,160,226 | 12/1964 | Jack et al. | 181/295 |
| 3,493,032 | 2/1970 | Brown, Jr. et al. | 16/87 R |
| 3,497,905 | 3/1970 | Pflum | 16/87.2 |
| 3,605,200 | 9/1971 | Vallinotto et al. . | |
| 3,857,459 | 12/1974 | Adams et al. | 181/295 |

*Primary Examiner*—L. T. Hix
*Assistant Examiner*—Benjamin R. Fuller
*Attorney, Agent, or Firm*—Ronald C. Hudgens; Philip R. Cloutier; Paul J. Rose

[57] ABSTRACT

A ceiling baffle includes a glass cloth faced fibrous glass board, grooved and folded to provide a double thickness of board. End caps for the folded board are each provided with blade portions extending between the two thicknesses of board and with a hole in an upper wall portion for receiving a barb portion of a suspension clip attachable to an inverted T-bar of a ceiling grid system for mounting ceiling panels.

5 Claims, 9 Drawing Figures

10
12
14
12c
12a
12b
16
18
20
20a
20b
20c
20e
20f
20g
20h
20i
20j
20k
14a
14b
14c
14d
14e
14f
14g
14h

END CAP AND SUSPENSION MEANS FOR ACOUSTICAL CEILING BAFFLE

This invention relates generally to acoustical ceiling baffles, and more particularly to end caps for such baffles and means for suspending the baffles by the end caps from an inverted T-bar ceiling grid system.

An object of the invention is to provide an improved end cap for ceiling baffles and means for suspending the ceiling baffles by the end caps.

Other objects will become apparent when the following specification is considered along with the accompanying drawings in which.

Figures 1, 2, 3, 4, 5, 6, 7, 8, 9:
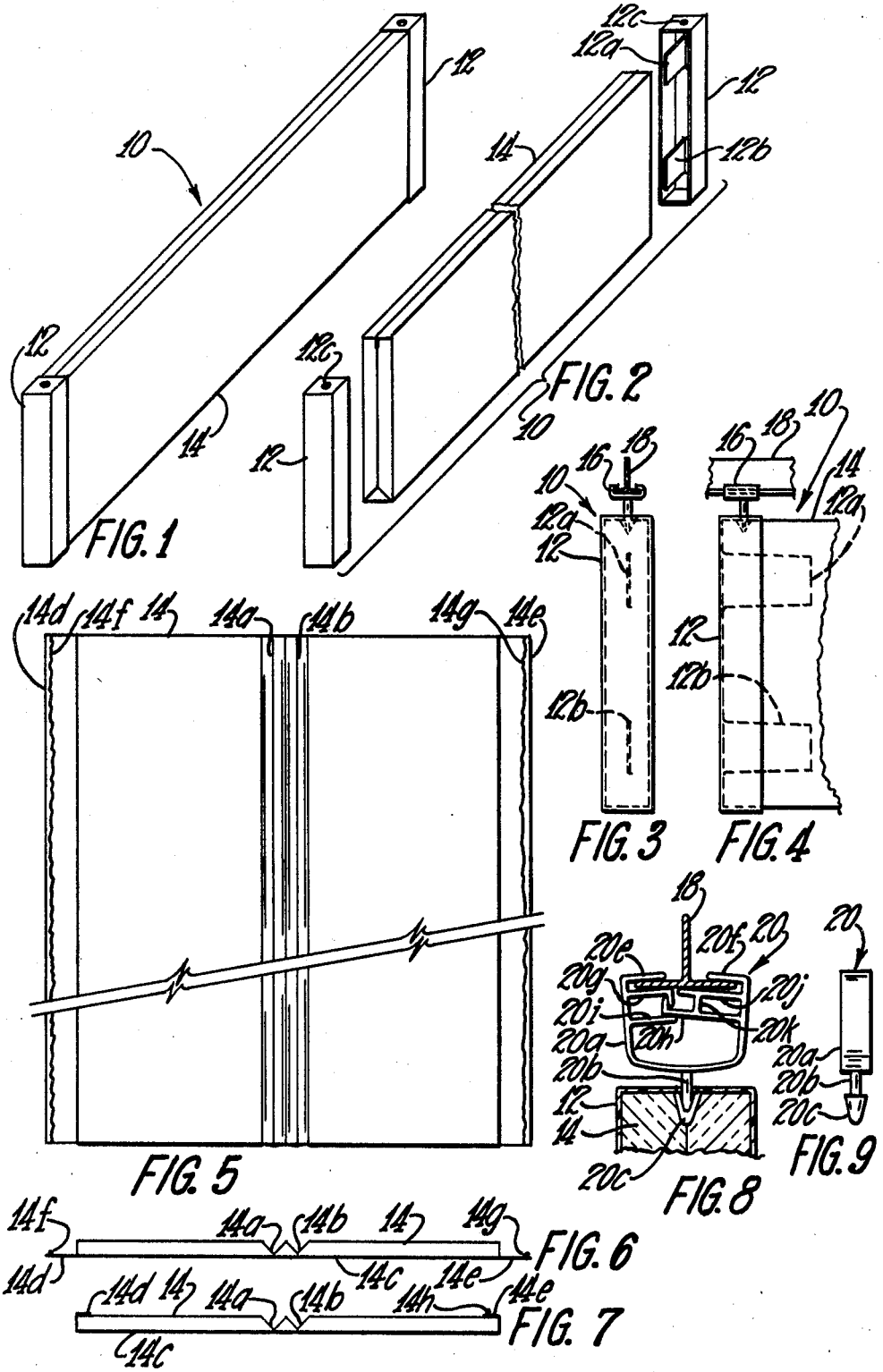
FIG. 1 is a perspective view of an acoustical ceiling baffle having end caps constructed in accordance with the invention.
FIG. 2 is an exploded perspective view of the baffle of FIG. 1.
FIG. 3 is an end view, partially in section, of the baffle of FIG. 1 suspended from an inverted T-bar by suspension means constructed in accordance with the invention.
FIG. 4 is a fragmentary side view of the baffle of FIG. 1 suspended from an inverted T-bar.
FIG. 5 is a top plan view of a grooved fibrous glass board forming a part of the baffle of FIG. 1.
FIG. 6 is an end view of the grooved board of FIG. 5 with facing material on the bottom.
FIG. 7 is a view similar to FIG. 6, but with flaps of the facing material wrapped around the opposite edge portions of the board.
FIG. 8 is a view similar to FIG. 3, but showing a preferred form of suspension clip constructed in accordance with the invention.
FIG. 9 is an elevational view of the suspension clip of FIG. 8, taken from the right-hand side of FIG. 8.

With respect to the drawings, FIGS. 1 to 4 show an acoustical ceiling baffle 10 of the type claimed in the copending application of David A. Harris and James E. Jones, Ser. No. 973,702, filed Nov. 27, 1978, and entitled "Acoustical Ceiling Baffle and Method Of Making". The baffle 10 has a pair of molded plastic end caps 12 constructed in accordance with the invention and mounted on a grooved and folded, glass cloth faced fibrous glass board 14. Each end cap 12 is provided with a pair of upper and lower blade portions 12*a* and 12*b* extending from the inner side of an end wall portion thereof, as shown on the upper end cap 12 in FIG. 2 and shown in truer proportion in FIG. 4. Further, an upper wall portion of each end cap 12 has an aperture 12*c* for receiving a barb portion of a suspension clip 16 attachable to the inverted T-bars 18 of a ceiling grid for mounting acoustical ceiling panels (not shown). FIG. 8 shows a molded plastic suspension clip 20 which is the preferred form and includes a generally U-shaped body portion 20*a* having a pair of leg portions connected by a bight portion, and a rod portion 20*b* depending from the bight portion and having a barb portion 20*c* on a lower end portion thereof. The body portion 20*a* is flexible, particularly where the leg portions meet the bight portion. Each leg portion of the body portion 20*a* has three inwardly extending cantilever portions the opposite upper ones 20*e* and 20*f* of which extend over the head of the inverted T-bar 18 when the suspension clip 20 is mounted thereon. An intermediate cantilever portion 20*g* disposed below the cantilever portion 20*e* and having a downwardly extending projection on the free end portion thereof interlocks with a lower cantilever portion 20*h* disposed below the cantilever portion 20*f* and having an upwardly extending projection on the free end portion thereof. A lower cantilever portion 20*i* disposed below the cantilever portion 20*g* aids in retaining the cantilever portions 20*g* and 20*h* in interlocked relationship to retain the clips on the inverted T-bar 18. An intermediate stiffening cantilever portion 20*j* is connected to the cantilever portion 20*h* by a web 20*k*. The free end portion of the cantilever portion 20*j* enables the clip 20 to be suspended from a wire when there are no inverted T-bars 18 and is preferably provided with an arcuate recess (not shown) for seating a wire.

FIGS. 5 and 6 show the fibrous glass board 14 before it is folded. A facing material 14*c*, preferably woven glass cloth, is adhered to one side of the board by a suitable adhesive. The facing material 14*c* includes flaps 14*d* and 14*e* respectively extending transversely beyond the longitudinal edges of the board 14. The board 14 is provided with longitudinal generally V-shaped grooves 14*a* and 14*b* on the unfaced side adjacent the transverse center. The sides of each of the grooves are substantially ninety degrees apart and each side forms an angle of about forty-five degrees with the general plane of the board.

In the forming of the baffle 10, after the grooves 14*a* and 14*b* are cut by a grooving machine, strips of glue 14*f* and 14*g* are deposited respectively on the inner side of the flaps 14*d* and 14*e* longitudinally along their outermost edges and the flaps are wrapped respectively around the edge portions of the board as shown in FIG. 7. Thereafter another strip of glue 14*h* is deposited longitudinally along one of the folded over flaps 14*d* and 14*e* on the outer side thereof, as shown on the flap 14*e* in FIG. 7. The board 14 is then folded together as shown in FIG. 2 and the end caps 12 pressed into place, the blade portions 12*a* and 12*b* extending between the two thicknesses of the board to aid in anchoring the end caps on the board. Preferably glue is first applied to the inside of the end wall portion of each end cap. If desired, glue may also be placed on the blade portions.

Various modifications may be made in the structure shown and described without departing from the spirit and scope of the invention.

We claim:

1. For use with inverted T-bar ceiling grid systems for mounting ceiling panels, an acoustical ceiling baffle and suspension clip kit comprising:

(a) an acoustical ceiling baffle including a fibrous board grooved and folded to provide two thickness of the board and a pair of end caps mounted respectively over opposite end portions of the folded board, each of the end caps having a blade portion extending from an inner side of an end wall portion thereof between the two thicknesses of the board and having an aperture in an upper wall portion thereof; and (b) a pair of suspension clips each including a generally U-shaped body portion having a bight portion and a pair of opposite leg portions, a rod portion depending from the bight portion and having a barb portion on a lower end portion thereof receivable in one of the end caps through the aperture in the upper wall portion, a pair of upper cantilever portions extending inwardly respectively from free end portions of the leg portions and overlapping the head portion of an inverted T-bar of a ceiling grid system when the clip is in use, and a pair of interlockable lower cantilever portions extending inwardly respctively from the leg portions and interlocking with each other when the clip is in use to maintain the upper cantilever portions in overlapping relationship with the head portion of the inverted T-bar.

2. A suspension clip for suspending ceiling baffles from inverted T-bar ceiling grid systems, the clip comprising a generally U-shaped body portion having a bight portion and a pair of opposite leg portions, a rod portion depending from the bight portion and having a barb portion on a lower end portion thereof, a pair of upper cantilever portions extending inwardly respectively from free end portion of the leg portions and overlapping the head portion of an inverted T-bar of a ceiling grid system when the clip is in use, and a pair of interlockable lower cantilever portions extending inwardly respectively from the leg portions and interlocking with each other when the clip is in use to maintain the upper cantilever portions in overlapping relationship with the head portion of the inverted T-bar.

3. A suspension clip for suspending ceiling baffles from inverted T-bar ceiling grid systems, the clip comprising a generally U-shaped body portion having a bight portion and a pair of opposite leg portions, a rod portion depending from the bight portion and having a barb portion on a lower end portion thereof, and three vertically spaced inwardly extending cantilever portions on each of the leg portions, upper opposite ones of the cantilever portions overlapping the head portion of an inverted T-bar of a ceiling grid system when the clip is in use, an intermediate one of the cantilever portions on a first one of the leg portions having a downwardly extending projection on the free end portion thereof interlocked with an upwardly extending projection on the free end portion of a lower one of the cantilever portions on a second one of the leg portions when the clip is in use to retain the clip on the inverted T-bar, a lower one of the cantilever portions on the first one of the leg portions aiding in retaining the projections in interlocked relationship when the clip is in use, and an intermediate one of the cantilever portions on the second one of the leg portions being connected by a web to the lower one of the cantilever portions thereon.

4. A suspension clip as claimed in claim 3 and molded of thermoplastic material.

5. A suspension clip as claimed in claim 3 wherein the intermediate one of the cantilever portions on the second one of the leg portions has a free end portion extending past the web and adapted to suspend the clip from a wire.

* * * * *